US010136720B2

(12) United States Patent
Hasegawa

(10) Patent No.: US 10,136,720 B2
(45) Date of Patent: Nov. 27, 2018

(54) COSMETIC CONTAINER

(71) Applicant: AMG CO., LTD., Tokyo (JP)

(72) Inventor: Hiroki Hasegawa, Tokyo (JP)

(73) Assignee: AMG Co., Ltd., Tokyo (JP)

( * ) Notice: Subject to any disclaimer, the term of this patent is extended or adjusted under 35 U.S.C. 154(b) by 0 days.

(21) Appl. No.: 15/510,979

(22) PCT Filed: Apr. 12, 2016

(86) PCT No.: PCT/JP2016/001987

§ 371 (c)(1),
(2) Date: Mar. 13, 2017

(87) PCT Pub. No.: WO2017/179084

PCT Pub. Date: Oct. 19, 2017

(65) Prior Publication Data

US 2018/0153275 A1 Jun. 7, 2018

(51) Int. Cl.
*B05C 1/00* (2006.01)
*A45D 34/04* (2006.01)
(Continued)

(52) U.S. Cl.
CPC ..... *A45D 34/045* (2013.01); *A45D 34/042* (2013.01); *A45D 40/24* (2013.01);
(Continued)

(58) Field of Classification Search
CPC ..... A45D 34/06; A45D 34/045; A45D 40/24; A45D 40/265
See application file for complete search history.

(56) References Cited

U.S. PATENT DOCUMENTS 2,458,063 A * 1/1949 Dulberg ..... A45D 34/06 132/314
9,022,042 B1 * 5/2015 Fichtl ..... A45D 40/24 132/218

(Continued)

FOREIGN PATENT DOCUMENTS

GB 2445934 B 8/2011
JP 4648396 1/1973

(Continued)

OTHER PUBLICATIONS

Japanese Patent Office, International Search Report and Written Opinion received in PCT/JP2016/001987, dated Aug. 9, 2016.

*Primary Examiner* — Jennifer C Chiang
(74) *Attorney, Agent, or Firm* — Procopio Cory Hargreaves and Savitch LLP

(57) ABSTRACT

A cosmetic container includes a first cap that removably engages with a first end of the container main part and includes an applicator for applying the cosmetic product. The container includes a second cap that removably engages with a second end of the container main part. A finishing tool for finishing makeup is placed at a position of the container main part near the second end, a diameter of the first cap increases from a connection portion with the container main part toward a closed end of the first cap and has a maximum diameter at a position between the connection portion and the closed end. A diameter of the second increases from a connection portion with the container main part toward a closed end of the second cap and has a maximum diameter at a position between the connection portion and the closed end.

3 Claims, 5 Drawing Sheets

(51) Int. Cl.
*A46B 5/00* (2006.01)
*A45D 40/24* (2006.01)
*A45D 40/26* (2006.01)

(52) U.S. Cl.
CPC ..... *A45D 40/262* (2013.01); *A45D 40/265* (2013.01); *A46B 5/00* (2013.01); *A45D 2200/25* (2013.01)

(56) References Cited

U.S. PATENT DOCUMENTS

| | | | | |
|---|---|---|---|---|
| 2004/0190974 | A1 | 9/2004 | Cantone et al. | |
| 2006/0072957 | A1* | 4/2006 | Wu | A45D 34/045 401/129 |
| 2007/0077112 | A1* | 4/2007 | Santamaria | A45D 40/24 401/17 |
| 2010/0003065 | A1 | 1/2010 | Haan | |
| 2016/0374457 | A1* | 12/2016 | Golding | A45D 40/265 132/317 |
| 2017/0105507 | A1* | 4/2017 | Golding | A45D 40/24 |

FOREIGN PATENT DOCUMENTS

| | | | |
|---|---|---|---|
| JP | 4957406 | | 12/1975 |
| JP | 2005516639 | A | 6/2005 |
| JP | 2008104738 | A | 5/2008 |
| JP | 5069047 | B2 | 1/2009 |
| JP | 5226298 | B2 | 7/2009 |
| JP | 2009219631 | A | 10/2009 |
| JP | 201012223 | A | 1/2010 |
| JP | 200529243 | A | 5/2010 |
| JP | 5290201 | B2 | 9/2013 |
| JP | 2014532486 | A | 12/2014 |

* cited by examiner

COSMETIC CONTAINER

FIELD

The present invention relates to a cosmetic container with an applicator.

BACKGROUND

A cosmetic container with an applicator has a container main part that has a cosmetic product such as foundation stored therein, and a cap portion that closes an opening of the container main part as main constituent elements. An applicator such as a brush is placed on the cap portion. It is important to such a cosmetic container that a user can operate the cosmetic container effectively and comfortably to enable the cosmetic product to be taken out.

For example, Patent Literature 1 proposes a cosmetic container that prevents scatter of a cosmetic product while an applicator is put in and taken out of a container main part.

CITATION LIST

Patent Literature

Patent Literature 1: Japanese Patent No. 5069047

SUMMARY

Technical Problem

When using a cosmetic container, the user needs to perform operations of grasping a container main part (step 1), removing a cap from the container main part to take out an applicator (step 2), applying makeup (step 3), and fitting the cap again onto the container main part (step 4). The technique described above enables an appropriate amount of the cosmetic product to adhere to the applicator to intend prevention of scatter of the cosmetic product at step 2; however, the usability of the user during removal of the cap from the container main part is not considered.

The present invention has been achieved in view of the above problem and an object of the present invention is to provide a cosmetic container that can be used effectively and comfortably by a user in processes of grasping a container main part, removing a cap from the container main part to take out an applicator, applying makeup, and fitting the cap again onto the container main part.

Solution to Problem

A first invention is a cosmetic container comprising: a container main part in a substantially cylindrical shape that has a cosmetic product stored therein; a first cap that removably engages with a first end of the container main part and comprises an applicator for applying the cosmetic product; and a second cap that removably engages with a second end of the container main part, wherein a finishing tool for finishing makeup is placed at a position of the container main part near the second end, a diameter of the first cap is formed to increase from a connection portion with the container main part toward a closed end of the first cap and to have a maximum value at a position between the connection portion and the closed end, and a diameter of the second cap is formed to increase from a connection portion with the container main part toward a closed end of the second cap and to have a maximum value at a position between the connection portion and the closed end.

Inventors of the present invention focused attention on a fact that applying makeup includes two stages, that is, application of a cosmetic product and finish thereof and arrived a structure of a cosmetic container having an applicator and a finishing tool. The inventors then studied a structure of human hands at the time of taking the applicator and the finishing tool out of a container main part. As a result of trials and errors, the inventors found that the configuration of the first invention enabled the user to use the cosmetic container effectively and comfortably in the processes of grasping the container main part, removing the cap from the container main part to take out the applicator, applying makeup, and fitting the cap again onto the container main part.

A second invention is the cosmetic container with the configuration of the first invention, wherein a ratio $\alpha 1$ (L4/L1) of a length L4 of the first cap to a length L1 of the cosmetic container is not less than 0.2 and not more than 0.3, a ratio $\alpha 2$ (L2/L1) of a length L2 of the second cap to the length L1 of the cosmetic container is not less than 0.2 and not more than 0.3, a ratio $\alpha 3$ (L3/L1) of a length L3 of the container main part to the length L1 of the cosmetic container is not less than 0.4 and not more than 0.6, and a length (L4+L2) of a combination of the length L4 and the length L2 is equal to or larger than the length L3.

The inventors of the present invention found that the user could perform an operation of attaching or detaching the first cap and the second cap effectively when the lengths L1, L2, L3, and L4 had relations described above due to a relation with the lengths of fingers of human hands.

A third invention is the cosmetic container with the configuration of the first invention or the second invention, wherein assuming that a maximum diameter of the second cap is a diameter ø1, a maximum diameter of the first cap is a diameter ø2, a diameter at the connection portion between the container main part and the first cap is a diameter ø3, and a diameter at the connection portion between the container main part and the second cap is a diameter ø4, a ratio $\beta 1$ (ø2/ø1) of the diameter ø2 to the diameter ø1 is not less than 0.60 and not more than 0.75, a ratio $\beta 2$ (ø3/ø1) of the diameter ø3 to the diameter ø1 is not less than 0.55 and not more than 0.70, a ratio $\beta 3$ (ø4/ø1) of the diameter ø4 to the diameter ø1 is not less than 0.65 and not more than 0.85, and a ratio $\beta 4$ (ø3/ø2) of the diameter ø3 to the diameter ø2 is not less than 0.85 and not more than 0.97.

The inventors of the present invention found that the user could perform the operation of attaching or detaching the first cap and the second cap more effectively when the diameters ø1, ø2, ø3, and ø4 had relations described above because of a relation with structures of human hands and fingers.

Advantageous Effects of Invention

According to the cosmetic container of the present invention, the user can use the cosmetic container effectively and comfortably in the processes of grasping the container main part, removing the cap from the container main part to take out the applicator, applying makeup, and fitting the cap again onto the container main part.

DESCRIPTION OF EMBODIMENTS

Exemplary embodiments of the present invention will be explained below in detail with reference to the accompanying drawings.

As illustrated in FIGS. 1, 2, 3, 4, and 5, a cosmetic container 1 (hereinafter, "container 1") has a general shape that is a substantially columnar shape having diameters near both ends larger than a diameter at a central portion. The maximum diameter near one of the ends is larger than the maximum diameter near the other end. The container 1 includes a container main part 50 in a substantially cylindrical shape that has a cosmetic product such as liquid foundation stored therein, a first cap 10, and a second cap 100.

Figure 1:
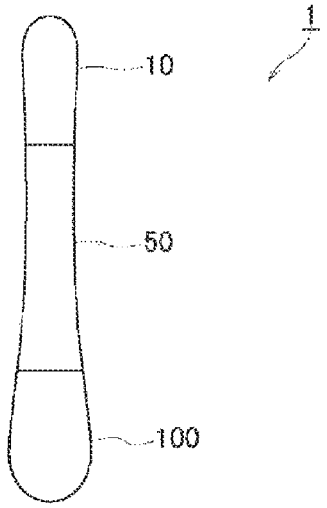
FIG. 1 is a schematic general view of a cosmetic container according to one embodiment of the present invention.
Figure 2:
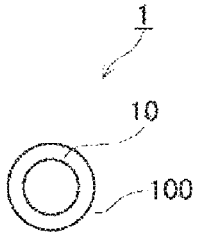
FIG. 2 is a plan view illustrating the cosmetic container.
Figure 3:
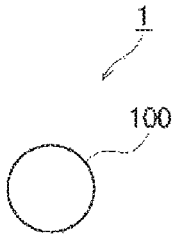
FIG. 3 is a bottom view illustrating the cosmetic container.
Figure 4:
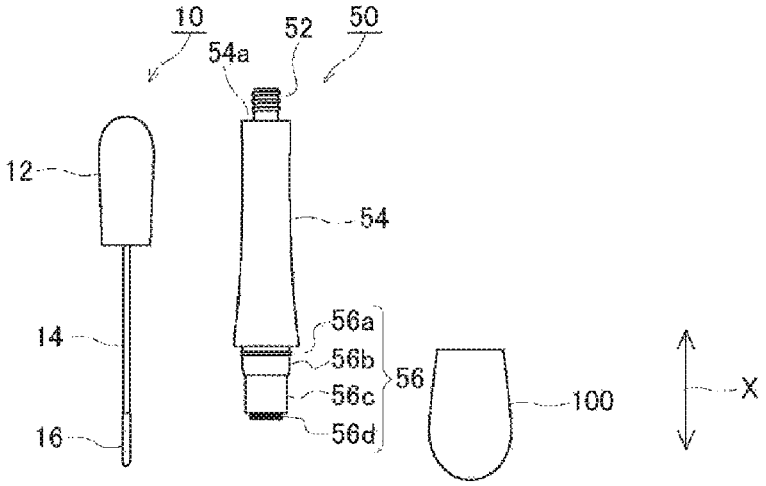
FIG. 4 is an exploded view of the cosmetic container.

As illustrated in FIG. 4, the first cap 10 includes a cap main part 12, a shaft portion 14, and an applicator 16. A thread (not illustrated) is formed near an open end of the cap main part 12 and is screwed with a threaded portion 52 formed on a first end 54*a* (see FIG. 4) of the container main part 50 to be removably engaged therewith. A part of the first cap 10 near a closed end 10*b* (see FIG. 5) is formed in a substantially hemispherical shape.

An annular concave portion (not illustrated) that is engaged with a convex portion 56*a* (see FIG. 4) of the container main part is formed on an inner side of the second cap 100 near an open end and is removably engaged with the container main part 50. A part of the second cap 100 near a closed end 100*b* (see FIG. 5) is formed in a substantially hemispherical shape.

As illustrated in FIG. 4, the container main part 50 includes the threaded portion 52, a body portion 54, and a finishing tool portion 56. The threaded portion 52 is formed on one end 54*a* of the body portion 54. An end of the threaded portion 52 is open, through which the shaft portion 14 and the applicator 16 of the first cap 10 can be housed in the body portion 54. The finishing tool portion 56 includes a base portion 56*b*, the concave portion 56*a* formed in an annular shape to surround the base portion 56*b*, a cylinder 56*c* that slides vertically (in directions of arrows X in FIG. 4), and a brush 56*d* as an example of a finishing tool. The brush 56*d* is formed of a plurality of bristles.

A ratio $\alpha 1$ (L4/L1) of a length L4 of the first cap 10 to a length L1 of the container 1 is not less than 0.2 and not more than 0.3. A ratio $\alpha 2$ (L2/L1) of a length L2 of the second cap 100 to the length L1 of the container 1 is not less than 0.2 and not more than 0.3. A ratio $\alpha 3$ (L3/L1) of a length L3 of the container main part 50 to the length L1 of the container 1 is not less than 0.4 and not more than 0.6. A length (L4+L2) of a combination of the length L4 and the length L2 is equal to or larger than the length L3. In the present embodiment, L1 is 131 mm (millimeters), L2 is 36 mm, L3 is 61 mm, and L4 is 34 mm. The ratio $\alpha 1$ (L4/L1) is 0.26, the ratio $\alpha 2$ (L2/L1) is 0.27, and the ratio $\alpha 3$ (L3/L1) is 0.47.

Figure 5:
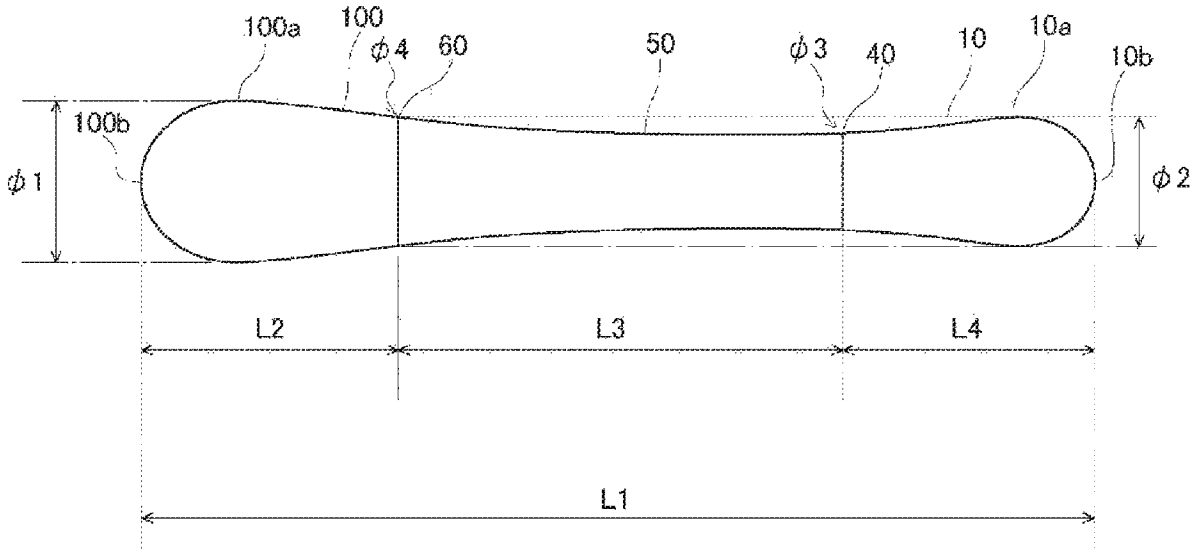
FIG. 5 is a general view illustrating the cosmetic container.

As illustrated in FIG. 5, the diameter of the first cap 10 is formed to increase from a connection portion 40 with the contain main part 50 toward the closed end 10*b* of the first cap 10 and to have a maximum diameter ø2 at a position 10*a* between the connection portion 40 and the closed end 10*b*.

The diameter of the second cap 100 is formed to increase from a connection portion 60 with the container main part 50 toward the closed end 100*b* of the second cap 100 and to have a maximum diameter ø1 at a position 100*a* between the connection portion 60 and the closed end 100*b*. The diameter ø1 is also the maximum diameter in the entire container 1.

It is assumed that a diameter at the connection portion 40 between the container main part 50 and the first cap 10 is a diameter ø3 and that a diameter at the connection portion 60 between the container main part 50 and the second cap 100 is a diameter ø4. A ratio $\beta 1$ (ø2/ø1) of the diameter ø2 to the diameter ø1 is not less than 0.60 and not more than 0.75 and is more preferably not less than 0.65 and not more than 0.70. A ratio $\beta 2$ (ø3/ø1) of the diameter ø3 to the diameter ø1 is not less than 0.55 and not more than 0.70 and is more preferably not less than 0.57 and not more than 0.65. A ratio $\beta 3$ (ø4/ø1) of the diameter ø4 to the diameter ø1 is not less than 0.65 and not more than 0.85. A ratio $\beta 4$ (ø3/ø2) of the diameter ø3 to the diameter ø2 is not less than 0.85 and not more than 0.97 and is more preferably not less than 0.87 and not more than 0.95. In the present embodiment, the diameter ø1 is 22 mm (millimeters), the diameter ø2 is 15 mm, the diameter ø3 is 14 mm, and the diameter ø4 is 15 mm. The ratio $\beta 1$ is 0.68, the ratio $\beta 2$ is 0.63, the ratio $\beta 3$ is 0.68, and the ratio $\beta 4$ is 0.93.

Focusing attention on a fact that makeup using foundation includes a step of applying foundation and a step of performing finish, the inventors of the present invention studied a structure of a cosmetic container that could achieve both the application and the finish effectively and found that the structure described above was suitable. This is explained with reference to FIGS. 6, 7, 8, and 9.

Figure 6:
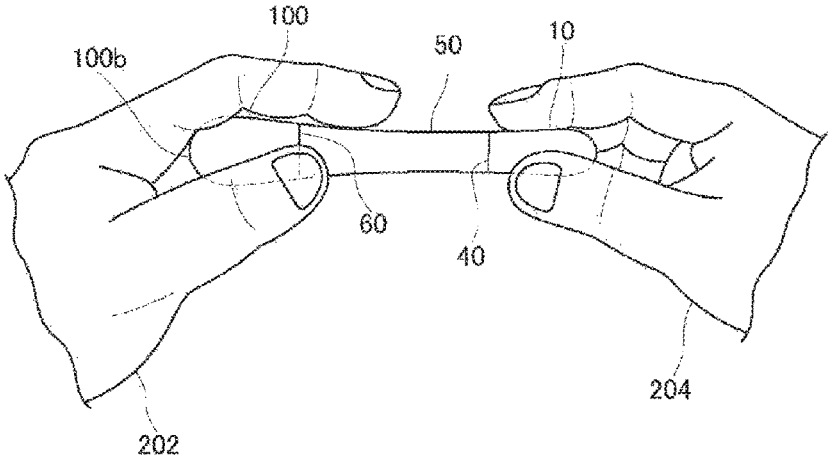
FIG. 6 illustrates an example of a method for using the cosmetic container.
Figure 7:
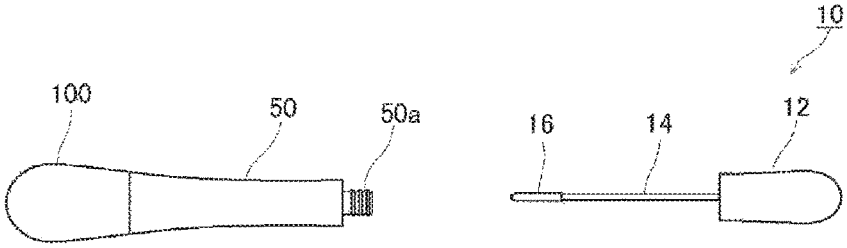
FIG. 7 illustrates a state of the cosmetic container from which an applicator is taken out.

When the first cap 10 is to be removed from the container main part 50 to take out the applicator on which the foundation adheres, a position near the connection portion 60 is grasped with the thumb and the index finger of a left hand 202 while the first cap 10 is grasped with the thumb and the index finger of a right hand 204, and the first cap 10 and the container main part 50 are turned relatively, for example, as illustrated in FIG. 6. This enables the cap 10 to be unscrewed from the container main part 50, resulting in a state where the applicator 16 is usable, as illustrated in FIG. 7.

Figure 8:
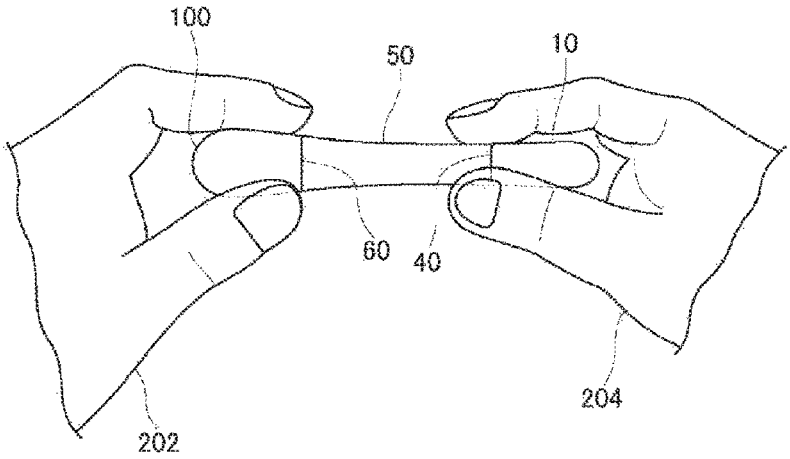
FIG. 8 illustrates an example of a method for using the cosmetic container.
Figure 9:
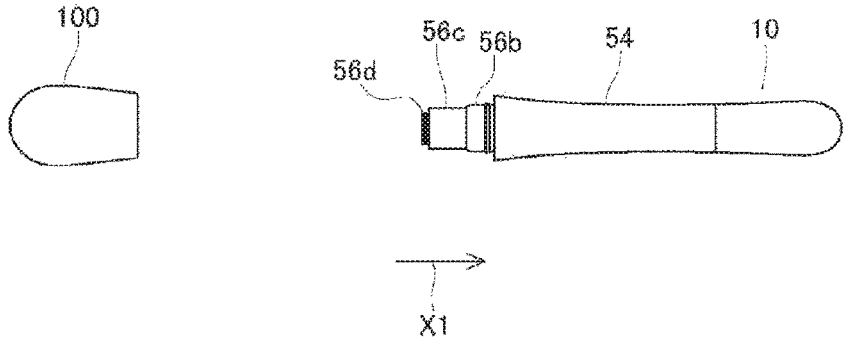
FIG. 9 illustrates a state of the cosmetic container from which a finishing tool is taken out.
Figure 10:
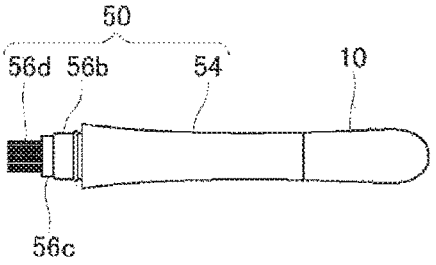
FIG. 10 illustrates the finishing tool in a usable state.

When the second cap 100 is to be removed from the container main part 50 to expose the brush 56*d* placed on the container main part 50, the second cap 100 is grasped with the thumb and the index finger of the left hand 202 while a position near the connection portion 40 is grasped with the thumb and the index finger of the right hand 204, and the second cap 100 is pulled out of the container main part 50, for example, as illustrated in FIG. 8. This enables the second cap 100 to be disengaged from the container main part 50 and the brush 56*d* is exposed as illustrated in FIG. 9. When the cylinder 56*c* is pushed down in the direction of an arrow X1, a state where the brush 56*d* is usable is obtained as illustrated in FIG. 10. The cylinder 56*c* is a configuration for bringing together the bristles that form the brush 56*d* when the cap 100 is to be engaged with the main part 50 and has a function to enable the cap 100 to be engaged with the main part 50 without damaging the brush 56*d*.

The inventors of the present invention focused attention on a fact that, from an ergonomic viewpoint, human hands in a natural state do not have flat shapes but have substantially hemispherical shapes around the direction of palms of the hands and studied a structure of the container 1 suitable for such a structure of the hands. The inventors of the present invention focused attention on a fact that the shape of a space formed between the thumb and the index finger in a natural state is a substantially conical shape decreasing in the diameter toward the direction of fingertips, and found that the first cap 10 or the second cap 100 could be detached or attached effectively and comfortably in the natural state of the human hands when the container 1 had the structure described above. Due to the maximum diameter ø1 of the second cap 100 and the diameter ø4 at the connection portion 60 falling within the numerical ranges described above, the thumb and the index finger of the left hand 202 in a state close to the natural state can catch on a curved surface of the second cap 100 to grasp the second cap 100. A relation between the first cap 10 and the right hand is also almost the same. Because the space naturally formed by the thumb and the index finger decreases in the diameter similarly to the second cap 100 decreasing in the diameter from the closed end 100*b* to the connection portion 60, the fingers of the user catch on the second cap 100 and can grasp the second cap 100 with no special regard required for the hand shape. The ratio β4 (ø3/ø2) is larger than the ratio β3 (ø4/ø1) and the diameter ø2 is smaller than the diameter ø1. This results from a viewpoint that while the brush 56*d* placed on the container main part 50 is merely exposed when the second cap 100 is removed from the container main part 50, the applicator 16 having the foundation adhering thereon is taken out when the first cap 10 is removed from the container main part 50 and accordingly a structure urging the user to perform a more careful motion is preferable. That is, when the applicator 16 is to be taken out, a more careful operation than that when the brush 56*d* is to be exposed is required. Because the ratio β4 (ø3/ø2) is larger than the ratio β3 (ø4/ø1) and the diameter ø2 is smaller than the diameter ø1, the user is naturally caused to concentrate attention and perform a careful motion when taking out the applicator 16.

Figure 11:
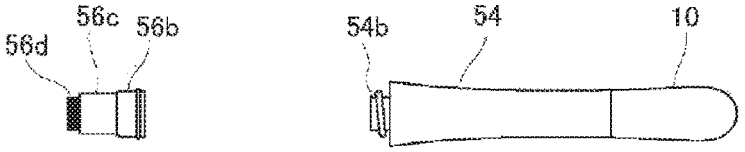
FIG. 11 is a schematic diagram illustrating a state where a refill portion is separated.

As illustrated in FIG. 11, the body portion 54 and the finishing tool portion 56 of the container main part 50 are separable. That is, a threaded portion 54*b* formed at an end of the body portion 54 and a thread (not illustrated) formed on the side of the finishing tool portion 56 are screwed to be capable of being removed. In the body portion 54, the end at which the threaded portion 54*b* is formed is a closed end. The body portion 54 and the first cap 10 are replaceable when all the foundation stored in the body portion 54 is consumed. That is, when having consumed all the foundation, the user does not need to newly buy the entire container 1 and it suffices to buy a refill member including the body portion 54 and the first cap 10.

The cosmetic container of the present invention is not limited to the embodiment described above and various modifications can be made without departing from the scope of the present invention.

REFERENCE SIGNS LIST

1 cosmetic container
10 first cap
12 cap main part
14 shaft portion
16 applicator
50 container main part
52 threaded portion
54 body portion
56 finishing tool portion
100 second cap

The invention claimed is:

1. A cosmetic container comprising:
a container main part in a substantially cylindrical shape that has a cosmetic product stored therein;
a first cap that removably engages with a first end of the container main part and comprises an applicator for applying the cosmetic product; and
a second cap that removably engages with a second end of the container main part, wherein
a finishing tool for finishing makeup is placed at a position of the container main part near the second end,
a diameter of the first cap is formed to increase from a connection portion with the container main part toward a closed end of the first cap and to have a maximum value at a position between the connection portion and the closed end, and
a diameter of the second cap is formed to increase from a connection portion with the container main part toward a closed end of the second cap and to have a maximum value at a position between the connection portion and the closed end, wherein
a ratio α1 (L4/L1) of a length L4 of the first cap to a length L1 of the cosmetic container is not less than 0.2 and not more than 0.3,
a ratio α2 (L2/L1) of a length L2 of the second cap to the length L1 of the cosmetic container is not less than 0.2 and not more than 0.3, and
a ratio α3 (L3/L1) of a length L3 of the container main part to the length L1 of the cosmetic container is not less than 0.4 and not more than 0.6.

2. A cosmetic container comprising:
a container main part in a substantially cylindrical shape that has a cosmetic product stored therein;
a first cap that removably engages with a first end of the container main part and comprises an applicator for applying the cosmetic product; and
a second cap that removably engages with a second end of the container main part, wherein
a finishing tool for finishing makeup is placed at a position of the container main part near the second end,
a diameter of the first cap is formed to increase from a connection portion with the container main part toward a closed end of the first cap and to have a maximum value at a position between the connection portion and the closed end, and
a diameter of the second cap is formed to increase from a connection portion with the container main part toward a closed end of the second cap and to have a maximum value at a position between the connection portion and the closed end, wherein
assuming that a maximum diameter of the second cap is a diameter ø1, a maximum diameter of the first cap is a diameter ø2, a diameter at the connection portion between the container main part and the first cap is a diameter ø3, and a diameter at the connection portion between the container main part and the second cap is a diameter ø4,
a ratio β1 (ø2/ø1) of the diameter ø2 to the diameter ø1 is not less than 0.60 and not more than 0.75, a ratio β2 (ø3/ø1) of the diameter ø3 to the diameter ø1 is not less than 0.55 and not more than 0.70, a ratio β3 (ø4/ø1) of the diameter ø4 to the diameter ø1 is not less than 0.65 and not more than 0.85, and a ratio β4 (ø3/ø2) of the diameter ø3 to the diameter ø2 is not less than 0.85 and not more than 0.97.

3. The cosmetic container according to claim 1, wherein assuming that a maximum diameter of the second cap is a diameter ø1, a maximum diameter of the first cap is a diameter ø2, a diameter at the connection portion between the container main part and the first cap is a diameter ø3, and a diameter at the connection portion between the container main part and the second cap is a diameter ø4, a ratio β1 (ø2/ø1) of the diameter ø2 to the diameter ø1 is not less than 0.60 and not more than 0.75, a ratio β2 (ø3/ø1) of the diameter ø3 to the diameter ø1 is not less than 0.55 and not more than 0.70, a ratio β3 (ø4/ø1) of the diameter ø4 to the diameter ø1 is not less than 0.65 and not more than 0.85, and a ratio β4 (ø3/ø2) of the diameter ø3 to the diameter ø2 is not less than 0.85 and not more than 0.97.

* * * * *